US008145078B2

(12) United States Patent
Mestha et al.

(10) Patent No.: US 8,145,078 B2
(45) Date of Patent: Mar. 27, 2012

(54) TONER CONCENTRATION SYSTEM CONTROL WITH STATE ESTIMATORS AND STATE FEEDBACK METHODS

(75) Inventors: Lalit Keshav Mestha, Fairport, NY (US); Sohail A. Dianat, Pittsford, NY (US); Bharathi Venkitaraman, Morton, IL (US); Douglas Kreckel, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 565 days.

(21) Appl. No.: 12/390,568

(22) Filed: Feb. 23, 2009

(65) Prior Publication Data

US 2009/0297179 A1 Dec. 3, 2009

Related U.S. Application Data

(60) Provisional application No. 61/056,284, filed on May 27, 2008.

(51) Int. Cl.
*G03G 15/08* (2006.01)
*G03G 15/10* (2006.01)

(52) U.S. Cl. ..... 399/30; 399/58

(58) Field of Classification Search ..... 399/30, 399/58, 59, 60, 61, 62, 63, 64, 65
See application file for complete search history.

(56) References Cited

U.S. PATENT DOCUMENTS

| | | | | |
|---|---|---|---|---|
| 2,956,487 | A | 10/1960 | Giaimo, Jr. | |
| 3,233,781 | A | 2/1966 | Grubbs | |
| 3,348,522 | A | 10/1967 | Donohue | |
| 3,348,523 | A | 10/1967 | Davidson | |
| 3,376,853 | A | 4/1968 | Weiler | |
| 3,719,165 | A | 3/1973 | Trachienberg | |
| 3,779,204 | A | 12/1973 | Altman | |
| 3,870,968 | A | 3/1975 | Vosteen | |
| 3,873,002 | A | 3/1975 | Davidson | |
| 3,876,106 | A | 4/1975 | Powell | |
| 4,065,031 | A | 12/1977 | Wiggins | |
| 4,205,257 | A | 5/1980 | Oguro | |
| 4,853,639 | A | 8/1989 | Vosteen | |
| 5,839,022 | A | 11/1998 | Wang et al. | |
| 6,088,095 | A | 7/2000 | Sharma | |
| 7,864,373 | B2 * | 1/2011 | Donaldson | 358/1.9 |
| 2007/0003297 | A1 * | 1/2007 | Hamby et al. | 399/30 |

* cited by examiner

*Primary Examiner* — David Gray
*Assistant Examiner* — Joseph S Wong
(74) *Attorney, Agent, or Firm* — Fay Sharpe LLP

(57) ABSTRACT

The present disclosure provides for an imaging machine having an imaging member including a method for maintaining a toner concentration. The method for maintaining the toner concentration comprises: determining a toner concentration (TC) measurement using a sensor; computing a state estimator output from the TC measurement and a pre-stored estimator gain matrix, $K_e$; computing an estimated target state from the state estimator and a pre-stored controller gain matrix, K; computing a duty cycle from the estimated target state, pixel count data, and pre-stored target decomposer output; and, updating the duty cycle by repeating the above method for the next TC cycle.

17 Claims, 5 Drawing Sheets

TONER CONCENTRATION SYSTEM CONTROL WITH STATE ESTIMATORS AND STATE FEEDBACK METHODS

BACKGROUND

This application claims the benefit of U.S. Provisional Application No. 61/056,284 filed May 27, 2008. The disclosure relates generally to an imaging machine and, more particularly, to the control of toner concentration.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In an electrophotographic apparatus, an electrostatic image, formed on the surface of a drum or web, is developed by the application of finely divided toner particles to form a toner image. In certain electrophotographic apparatus, toner images are formed from electrostatic images by brushing a developer mixture of ferromagnetic carrier particles and smaller toner particles across the electrostatic images. The contact of the ferromagnetic particles with the toner particles charges the toner particles by triboelectrification to a polarity needed in order that the toner particles are attracted to the electrostatic images for toning.

In the process of attracting toner particles to electrostatic images for toning, toner particles are depleted from the developer mixture requiring replenishment to avoid a gradual reduction in density of the toner images. Toner replenishment is accomplished by several different types of apparatus. In one type, a given amount of toner is added to the mixture after a given number of copies is made. This approach is acceptable if the amount of toner used for each copy is reasonably predictable. In some apparatus, however, the amount of toner used in any copy or group of copies can vary substantially. For this reason, toner concentration monitors have been designed which automatically add toner according to the results of a monitoring process.

Other examples of analog control are the use of a funnel in the developer apparatus to collect developing material. An inductance coil is wound about the funnel and connected to the motor of a toner dispenser through a bridge circuit. The reactance of the inductance coil varies in accordance to percentage of toner contained in the developing material. Other systems control a toner replenisher by measuring the electric potential of a magnetic developing brush. Still other systems control light reflected from a development brush to measure the concentration of toner in the developer housing. The reflective signal is fed to a computer and the computer determines whether or not the toner could be added and controls a toner replenishment device accordingly. In other approaches to improve toning, often referred to as "Auto-Bias", the potential of an electrode in the development station is adjusted as a function of the charge density of the electrostatic image.

Other systems control toner dispensers by measuring toner concentration in the developer mixture contained in a developer housing or reservoir, for example, reflecting a light beam from the developer mixture. The measure of the reflectivity of the mixture manifests the proportion of toner to carrier concentration in the mixture. Disadvantages with systems of this type are due in part to "noise" generated in the system, to the fact that the system is only an analog of the amount of toner actually applied to the photoreceptor surface, and to the dependence of the system to the constituents of the developer mixture.

The ratio between the number of toner particles to the number of carrier particles in the developer mixture, i.e. the toner concentration (TC), is a parameter which can change during a production run (unless efficiently controlled) and can contribute to color drift over time. Overall stability of a closed loop TC control system depends on how well the system components are optimized.

To improve overall TC performance, there are at least three major system components that can be optimized; (1) open loop toner replenishment (dispense) and mixing system (i.e., plant itself), (2) a TC measurement system (i.e, sensor), and (3) a closed loop control algorithm.

The present disclosure proposes a state based feedback control algorithm (i.e., a set of instructions) which can be targeted to control the TC in a two-component toner dispense system. A time-delay in the toner dispense can be replaced by states, and each state estimated using the measurement from the TC sensor. States can be defined by creating an open loop state based model of the system. States are estimated from the sensor output using the state estimator. Since each of those states can be controlled as the system evolves over time, we get improved dynamic performance.

The controller does not use an integrator. As a result of not using an integrator in the controller, an anti-windup compensator is not required. System simulation with iGen model, Packer sensor model, and simulated uncertainties is done and compared against prior art methods (i.e., PI controller). Area coverage disturbances, TC sensor drift and sensor noise are injected as uncertainties.

INCORPORATION BY REFERENCE

U.S. Pat. Nos. 5,839,022 by Wang et al., 3,870,968 by Vosteen et al., 4,205,257 by Oguro et al., and 4,853,639 by Vosteen et al., are incorporated herein by reference in their entirety.

SUMMARY

The present disclosure relates to methods and systems for controlling toner concentration in xerographic printing systems.

The present disclosure provides for an imaging machine having an imaging member including a method for maintaining a toner concentration. The method for maintaining the toner concentration comprises: determining a toner concentration (TC) measurement using a sensor; computing a state estimator output from the TC measurement and a pre-stored estimator gain matrix, $K_e$; computing an estimated target state from the state estimator and a pre-stored controller gain matrix, K; computing a duty cycle from the estimated target state, pixel count data, and pre-stored target decomposer output; and, updating the duty cycle by repeating the above method for the next TC cycle.

The present disclosure further provides for an imaging machine having an imaging member including a method for maintaining a toner concentration. The method comprises determining a toner concentration (TC) measurement for a print iteration (k) using a sensor wherein the TC is defined by the relationship: tcfiltered(k+1)=C*(1/Carriermass)*x(k)−(1/Carriermass)*$x_{\mu+2}$(k), and tc(k)=tonermass(k)/carriermass(k). The method further comprises computing a state estimator output from the TC and a pre-stored estimator gain matrix, $K_e$ wherein the state estimator output is defined by the relationship: xh(k+1)=A*xh(k)+B*massdispensed(k)+$K_e$*Carriermass*[tcfiltered(k)−(1/Carriermass)*xh(k)], and massdispensed(k)=maxdisprate*period*dutycyclefilt(k); computing an estimated target state from the state estimator and a pre-stored controller gain matrix, K wherein the estimated target state is defined by the relationship: xtargeth(k)=K*xh(k); and, computing a duty cycle from the estimated target state, pixel count data, and pre-stored target decomposer output, wherein the duty cycle is defined by the relationship: Dutycycle(k)=xtarget−xtargeth(k)+areacoverage(k+μ).

The present disclosure further provides for an imaging machine having an imaging member including a method for maintaining a toner concentration. The method comprises determining a current (k+1) print mass of toner wherein the current (k+1) print mass of toner includes a toner mass of a previous (k) print cycle plus a toner mass dispensed in the previous (k) print cycle minus a toner mass developed in the previous (k) print cycle, wherein the toner mass dispensed in the previous (k) print cycle is a mass of toner dispensed from a dispenser, and wherein the toner mass developed in the previous (k) print cycle is a mass of toner used in an image based on a consumption profile. The method further comprises determining a previous (k) carrier mass of toner wherein the previous (k) carrier mass of toner includes a sump mass minus the previous (k) mass of toner; determining a toner concentration wherein the toner concentration includes the previous (k) toner mass divided by the carrier mass of toner; determining the toner mass at discrete delay cycles wherein the delay cycles are split into states and the states are defined as toner mass quantities at discrete delay cycles; and, wherein the states are defined by the matrix:

$$\begin{bmatrix} x_1(k+1) \\ x_2(k+1) \\ \vdots \\ \vdots \\ x_{\mu+1}(k+1) \end{bmatrix} = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \begin{bmatrix} x_1(k) \\ x_2(k) \\ \vdots \\ \vdots \\ x_{\mu+1}(k) \end{bmatrix} + \begin{bmatrix} 1 \\ 0 \\ \vdots \\ \vdots \\ 0 \end{bmatrix} * massdispensed(k)$$

$$tonermass(k) = [\,0 \quad 0 \quad \dots \quad \dots \quad 1\,] * \begin{bmatrix} x_1(k) \\ x_2(k) \\ \vdots \\ \vdots \\ x_{\mu+1}(k) \end{bmatrix} - x_{\mu+2}(k)$$

-continued $$A = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \text{ and } B = \begin{bmatrix} 1 \\ 0 \\ \vdots \\ \vdots \\ 0 \end{bmatrix} \quad C = [\,0 \quad 0 \quad \dots \quad \dots \quad 1\,]$$

BRIEF DESCRIPTION OF THE DRAWINGS

Other features of the present disclosure will become apparent as the following description proceeds and upon reference to the drawings, in which.

DETAILED DESCRIPTION

Figure 1:
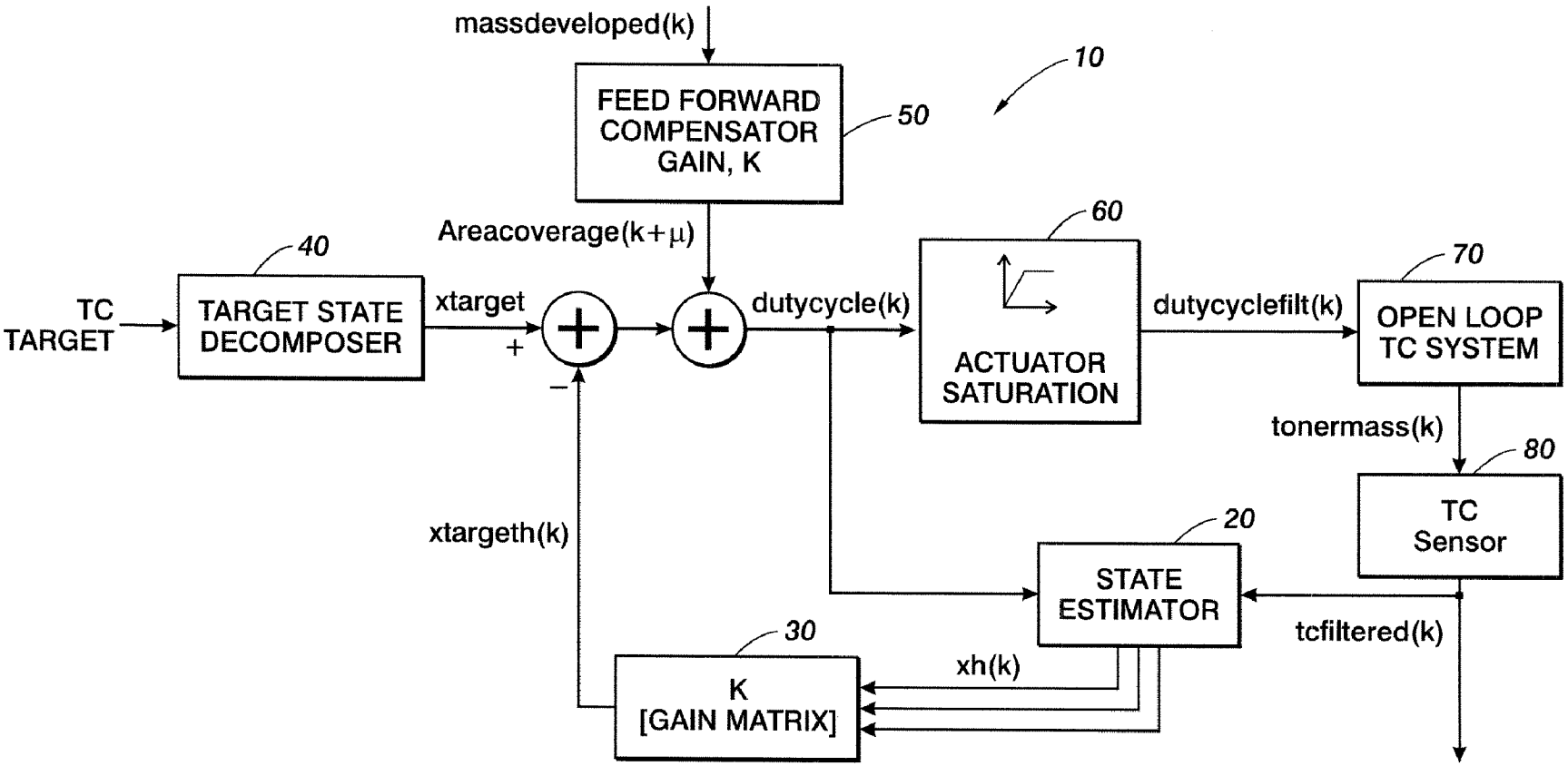
FIG. 1 illustrates a state estimator and state feedback controller for a level 1 toner concentration (TC) control loop which can be utilized in the practice of the present disclosure.

As discussed hereinafter, the present disclosure is equally well-suited for use in a wide variety of printing systems including electrophotographic printing machines, ionographic printing machines and discharge area development systems, as well as other more general nonprinting systems providing multiple variable outputs such that the disclosure is not necessarily limited in its application to the particular system shown herein.

To initiate a copying process, a multicolor original document can be positioned on a raster input scanner (RIS). The RIS can contain document illumination lamps, optics, a mechanical scanning drive, and a charge coupled device (CCD array) for capturing the entire image from the original document. The RIS can convert the image to a series of raster scan lines and measures a set of primary color densities, i.e. red, green and blue densities, at each point of the original document. This information is transmitted as an electrical signal to an image processing system (IPS), which converts the set of red, green and blue density signals to a set of colorimetric coordinates. The IPS contains control electronics for preparing and managing the image data flow to a raster output scanner (ROS).

A user interface (UI) can be provided for communicating with the IPS. UI enables an operator to control the various operator adjustable functions whereby the operator actuates the appropriate input keys of the UI to adjust the parameters of the copy. The UI may be a touch screen, or any other suitable device for providing an operator interface with the system. The output signal from the UI can be transmitted to the IPS which then transmits signals corresponding to the desired image to ROS.

The ROS can include a laser with rotating polygon mirror blocks. The ROS illuminates, via a mirror, a charged portion of a photoconductive belt of a printer or marking engine. A multi-facet polygon mirror can be used to illuminate the photoreceptor belt at a rate of about 400 pixels per inch. The ROS exposes the photoconductive belt to record a set of three subtractive primary latent images thereon corresponding to the signals transmitted from the IPS. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

A marking engine can be an electrophotographic printing machine comprising photoconductive belt which is entrained about transfer rollers, tensioning roller, and drive roller. The drive roller can be rotated by a motor or other suitable mechanism coupled to the drive roller by suitable means such as a belt drive. As roller rotates, it advances photoconductive belt to sequentially advance successive portions of the photoconductive belt through the various processing stations disposed about the path of movement thereof.

The photoconductive belt can be made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Finely divided particles of a photoconductive inorganic compound can be dispersed in an electrically insulating organic resin binder. Typical photoconductive particles include metal free phthalocyanine, such as copper phthalocyanine, quinacridones, 2,4-diamino-triazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of the photoconductive belt can pass through a charging station. At the charging station, a corona generating device or other charging device generates a charge voltage to charge the photoconductive belt to a relatively high, substantially uniform voltage potential. The corona generator comprises a corona generating electrode, a shield partially enclosing the electrode, and a grid disposed between the belt and the unenclosed portion of the electrode. The electrode charges the photoconductive surface of the belt via corona discharge. The voltage potential applied to the photoconductive surface of the belt can be varied by controlling the voltage potential of the wire grid.

Next, the charged photoconductive surface is rotated to an exposure station. The exposure station can receive a modulated light beam corresponding to information derived by the RIS having a multicolored original document positioned thereat. The modulated light beam impinges on the surface of photoconductive belt, selectively illuminating the charged surface of photoconductive belt to form an electrostatic latent image thereon. The photoconductive belt can be exposed three times to record three latent images representing each color.

After the electrostatic latent images have been recorded on photoconductive belt, the belt is advanced toward a development station. However, before reaching the development station, the photoconductive belt passes subjacent to a voltage monitor, i.e. an electrostatic voltmeter, for measurement of the voltage potential at the surface of the photoconductive belt. The electrostatic voltmeter can be any suitable type known in the art wherein the charge on the photoconductive surface of the belt is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present disclosure. The voltage potential measurement of the photoconductive belt is utilized to determine specific parameters for maintaining a predetermined potential on the photoreceptor surface, as will be understood with reference to the specific subject matter of the present disclosure, explained in detail hereinbelow.

The development station can include four individual developer units. The developer units can be of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

The developer units can apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt, while the green areas will be reduced to a voltage level ineffective for development. The charged areas are then made visible by having a first developer unit apply green absorbing (magenta) toner particles onto the electrostatic latent image recorded on photoconductive belt. Similarly, a blue separation is developed by a second developer unit with blue absorbing (yellow) toner particles, while the red separation is developed by a third developer unit with red absorbing (cyan) toner particles. A fourth developer unit can contain black toner particles and may be used to develop the electrostatic latent image formed from a black and white original document.

After development, the toner image is moved to a transfer station. The transfer station can include a transfer zone, defining the position at which the toner image is transferred to a sheet of support material, which may be a sheet of plain paper or any other suitable support substrate. A sheet transport apparatus moves the sheet into contact with the photoconductive belt. The sheet transport can have a belt entrained about a pair of substantially cylindrical rollers. A friction retard feeder advances the uppermost sheet from the stack onto a pre-transfer transport for advancing a sheet to the sheet transport in synchronism with the movement thereof so that the leading edge of the sheet arrives at a preselected position, i.e.

a loading zone. The sheet is received by the sheet transport for movement therewith in a recirculating path. As the belt moves, the sheet is moved into contact with the photoconductive belt, in synchronism with the toner image developed thereon.

In the transfer zone, a corona generating device sprays ions onto the backside of the sheet so as to charge the sheet to the proper magnitude and polarity for attracting the toner image from the photoconductive belt thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

It is to be appreciated that one of the developer units can include a developer such as a magnetic brush developer for applying toner to a latent image. The magnetic brush developer is generally provided in a developer housing and the rear of the housing usually forms a sump containing a supply of developing material. A passive crossmixer in the sump area generally serves to mix the developing material. It should be noted that magnetic brush development is only one example of a development system contemplated within the scope of the present disclosure.

As will be understood by those skilled in the art, the electrostatically attractable developing material commonly used in magnetic brush developing apparatus comprises a pigmented resinous powder, referred to as toner and larger granular beads referred to as carrier. To provide the necessary magnetic properties, the carrier is comprised of a magnetizable material such as steel. By virtue of the magnetic field established by the magnetic brush developer, a blanket of developing material is formed along the surface of the magnetic brush developer adjacent the photoreceptor surface. Toner is attracted to the electrostatic latent image from the carrier beads to produce a visible powder image on the surface.

The developer can be connected to a toner dispense assembly including a toner bottle providing a source of toner particles, an extracting auger for dispensing toner particles from the bottle, and a hopper receiving the toner particles from the auger. The hopper is also connected to a delivery auger and the delivery auger is rotated by a drive motor to convey toner particles from the hopper for distribution to the developer. A suitable low toner level sensor can provide signals to the system control that the toner bottle must be re-filled or replaced and a suitable toner concentration sensor within the developer housing can provide signals to the system control indicative of the toner concentration or ratio of toner and carrier in the developer.

A ratio between the number of toner particles to the number of carrier particles in the developer mixture, called the toner concentration (TC), is an important parameter which keeps changing (unless efficiently controlled) due to continuous toner development in high speed printers depending on the area coverage of images.

Overall performance of a closed loop TC control system can depend on three factors; (1) an open loop toner replenishment (dispense) and mixing system, (2) a TC measurement system and (3) a closed loop control algorithm.

Some of the uncertainties that contribute to inaccurate TC control are: inaccurate feedforward compensation, sensor noise, actuator saturation (i.e., limited dispense rate), time-delay in the toner dispenser, environmental effects, toner aging etc. Proportional Integral (PI) controller, with/without a Smith Predictor and an anti-windup compensator for compensating for integral action can be used as control algorithms proposed for process control systems.

The present disclosure provides for optimization of the closed loop control algorithm based on analysis of a dynamic TC system. State feedback controllers with state estimators, provides a good implementation due to its simplicity.

As shown in the block diagram of FIG. 1, a state estimator 20, gain matrix 30 and target state decomposer 40 comprise three components of the state feedback controller module 10. These three components comprise some of the algorithm module 10 which will be described in more detail hereinafter. A feed forward compensator 50 and an actuator saturation 60 are described in the U.S. Pat. No. 5,839,022, the contents of which are incorporated by reference herein. Estimated area coverage based on image pixel counts (shown as areacoverage(k+μ)) can form the feed forward compensator 50.

The parameters of the algorithm module 10 can be obtained by representing the open loop TC system 70 with a sensor 80 in state space form. In an open loop system the toner concentration can comprise the ratio of toner mass to the carrier mass. The system can be defined in terms of mass. This is a dynamic equation defined by (1) below where k represents a print iteration (or TC cycle).

$$\text{tonermass}(k+1)=\text{tonermass}(k)+\text{massdispensed}(k-\mu)-\text{massdeveloped}(k) \quad (1)$$

Here, tonermass is the mass of the toner (grams); massdispensed is the mass of toner dispensed from the dispenser (grams); massdeveloped is the mass of toner which is used in the image based on the consumption profile (grams); μ is the dispense delay (in number of cycles) and can include the delay in the mixing system; and, k is the print or iteration number.

The mass dispensed can be calculated by using the duty cycle of the motor obtained by the feedback controller as follows:

$$\text{massdispensed}(k)=\text{dutycyclefilt}(k)*\text{maxdisprate}*\text{period} \quad (2)$$

where, the maxdisprate (maximum dispense rate) is the maximum toner that can be dispensed from the sump. The massdeveloped can be calculated by using the area coverage profile of the image which comes from the feedforward pixel counter as follows:

$$\text{massdeveloped}(k)=\text{areacoverage}*\text{maxdevrate}*\text{period} \quad (3)$$

maxdevrate=maximum develop rate

From the value of toner mass which is calculated from the mass dispensed and the mass developed, one can calculate the carrier mass as follows:

$$\text{carriermass}(k)=\text{sumpmass}-\text{tonermass}(k) \quad (4)$$

The sump mass can be considered to be a constant (i.e. 3450 grams). The toner concentration (defined by tc below) can be calculated by the ratio of toner mass to carrier mass.

$$tc(k)=\text{tonermass}(k)/\text{carriermass}(k). \quad (5)$$

This toner concentration can be sensed by a Packer sensor or any other TC sensor. In the block diagram of FIG. 1, tc(k) of equation 5 is the same as tcfiltered(k).

A state space representation of the TC system, as described by equations 1 to 5, can have a delay of μ cycles. The μ cycles can be split into μ states. Formations of these states can be understood when the system equation is expressed in terms of z-transforms, a mathematical transformation used to represent sampled-data systems. In control systems, states are what characterize the system. States are not unique but can be transformed into different states using linear transformations.

In physical terms, for the TC system, states can be defined as quantities related to toner mass at discrete delay cycle. If the time delay is zero, i.e., when the toner dispense is instantaneous, number of states will be reduced to two (one due to the mass dispensed and another due to the mass developed) as seen from the state equation below.

$$x_1(k+1)=x_1(k)+\text{massdispensed}(k)$$

$$x_2(k+1)=x_1(k)$$

$$x_{\mu+1}(k+1)=x_\mu(k) \tag{6}$$

$$x_{\mu+2}(k+1)=x_{\mu+2}(k)+\text{massdeveloped}(k) \tag{7}$$

From the above equations, the state matrices can be formed. The above equations can be converted to matrix form by the following step:

$$\begin{bmatrix} x_1(k+1) \\ x_2(k+1) \\ \vdots \\ \vdots \\ x_{\mu+1}(k+1) \end{bmatrix} = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \begin{bmatrix} x_1(k) \\ x_2(k) \\ \vdots \\ \vdots \\ x_{\mu+1}(k) \end{bmatrix} + \begin{bmatrix} 1 \\ 0 \\ \vdots \\ \vdots \\ 0 \end{bmatrix} * massdispensed(k)$$

$$tonermass(k) = [\,0 \quad 0 \quad \dots \quad \dots \quad 1\,] * \begin{bmatrix} x_1(k) \\ x_2(k) \\ \vdots \\ \vdots \\ x_{\mu+1}(k) \end{bmatrix} - x_{\mu+2}(k)$$

$$A = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \text{ and } B = \begin{bmatrix} 1 \\ 0 \\ \vdots \\ \vdots \\ 0 \end{bmatrix} \quad C = [\,0 \quad 0 \quad \dots \quad \dots \quad 1\,]$$

The states can be grouped into vectors. With the above state matrices, the open loop system can be grouped as first order matrix difference equations.

$$x(k+1)=A*x(k)+B*\text{massdispensed}(k) \tag{8}$$

$$\text{tonermass}(k+1)=C*x(k)-x_{\mu+2}(k) \tag{9}$$

Once the toner mass is known, the TC can be obtained by the ratio of toner mass to carrier mass (equation 5). In other words, $$tc\text{filtered}(k+1)=C*(1/\text{Carriermass})*x(k)-(1/\text{Carriermass})*x_{\mu+2}(k) \tag{10}$$

The state space model can contain a system matrix A, a control matrix B, an output matrix C, actuator massdispensed and output tcfiltered (i.e., toner concentration). The physical quantity used for the actuator is the duty cycle for the dispenser which can be obtained from equation 2 (parameter dutycyclefilt(k) in FIG. 1). This state space equation is used to develop the state feedback estimator and state feedback controller. The state estimator, state controller and the target decomposer form some of the other aspects of the disclosure which is described below.

In state feedback, the state controller is a gain matrix 30 shown by K in FIG. 1. If xh(k) is the estimated state vector, then the output of the state controller can be given by:

$$x\text{target}h(k)=K*xh(k) \tag{11}$$

The estimation of the states, xh(k), is done using a multiple-input-multiple-output (MIMO) estimator algorithm shown below which is also known as a Leunberger observer in control literature.

$$xh(k+1)=A*xh(k)+B*\text{massdispensed}(k)+K_e*\text{Carriermass}*[tc\text{filtered}(k)-C*(1/\text{Carriermass})*xh(k)] \tag{12(a)}$$

$$\text{massdispensed}(k)=\text{maxdisprate}*\text{period}*\text{dutycyclefilt}(k) \tag{12(b)}$$

The xh(k+1) is the estimated state vector in (k+1)th cycle. Here $K_e$ is the estimator gain matrix. The estimator gain matrix can be found by using standard pole placement methods. The two poles considered are p1=0.2 and p2=0.25. Standard function, place( ), in Matlab can be used to compute the gain matrix. [E.g., $K_e$=place(A',C'*(1/Carriermass),p) where p=[p1;p2]]. State feedback gain matrix, K, is computed using the same function place( )[E.g., K=place(A,B,p) where p=[p1;p2]]. The pole values can be chosen slightly higher for the controller [E.g, p1=0.5 and p2=0.55].

If the TC target is denoted by a constant 'TCtarget', then a target decomposer can be a simple matrix equation involving the state feedback gain matrix and vectorized version of the TCtarget as shown below:

$$x\text{target}=K*xt \tag{13}$$

where $$xt = \begin{bmatrix} TCtarget \\ TCtarget \\ \vdots \\ \vdots \\ TCtarget \end{bmatrix}$$

Number of elements in the xt vector is equal to μ+1. Duty cycle can now be calculated as follows using equations 11 and 13 and the feedforward area coverage values.

$$\text{Dutycycle}(k)=x\text{target}-x\text{target}h(k)+\text{areacoverage}(k+\mu) \tag{14}$$

The real-time control algorithm code involves the computation of equations 11 to 14. Gain matrices, K, $K_e$, and target decomposer output, xtarget, can be pre-computed and stored as inputs to the controller.

A series of control algorithm steps can be described as follows:

1. Obtain TC measurement using the sensor (i.e. obtain tcfiltered data from the sensor);
2. Compute equation 12 (state estimator output) using output of step 1 and pre-stored estimator gain matrix, $K_e$;
3. Compute equation 11 (estimated target states or controller output) using output of step 2 and pre-stored controller gain matrix, K;
4. Compute equation 14 using the output of step 3, pixel count data and pre-stored target decomposer output; and,
5. Update the duty cycle (i.e., actuate the TC system) and continue with step 1 for the next TC cycle.

The state space model described by equations 8 and 10 can be used to compute the gain matrices, which can be done offline.

The performance of the control loop is evaluated by including the packer sensor model in the control code. The expected sensor drift is included in the simulation. Here, the performance is simulated for sensor noise, of 0 (i.e., no noise), 1%, and 5%. Different curves can be coded as follows; State feedback; PI controller and Smith Predictor PI controller only. One exemplary output would be a step change from 3 pph (%) toner concentration to 4 pph (%) toner concentration.

Figure 2:
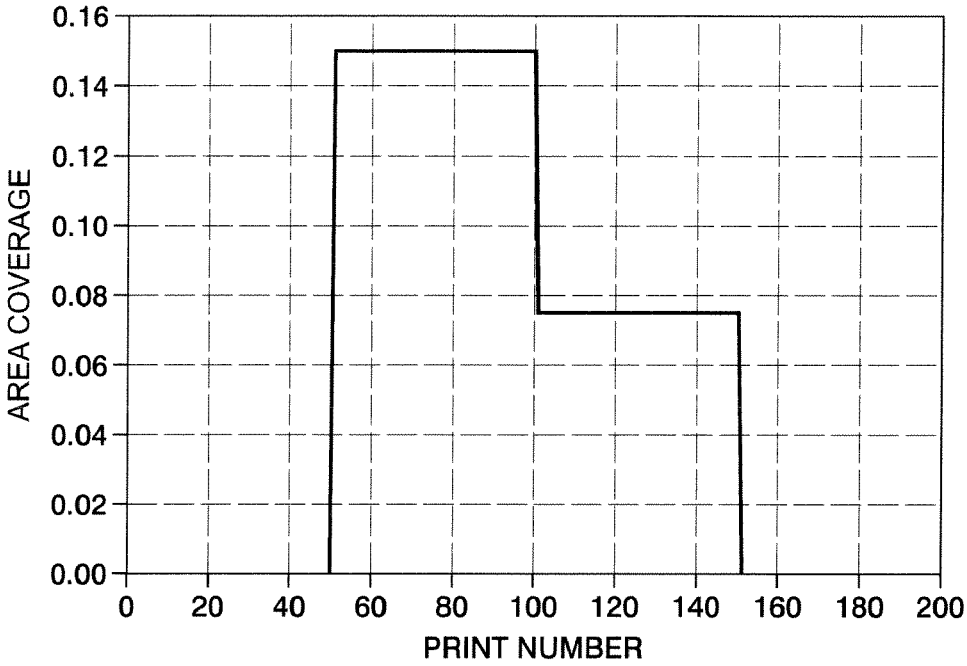
FIG. 2 illustrates an exemplary consumption or area coverage profile.
Figure 3:
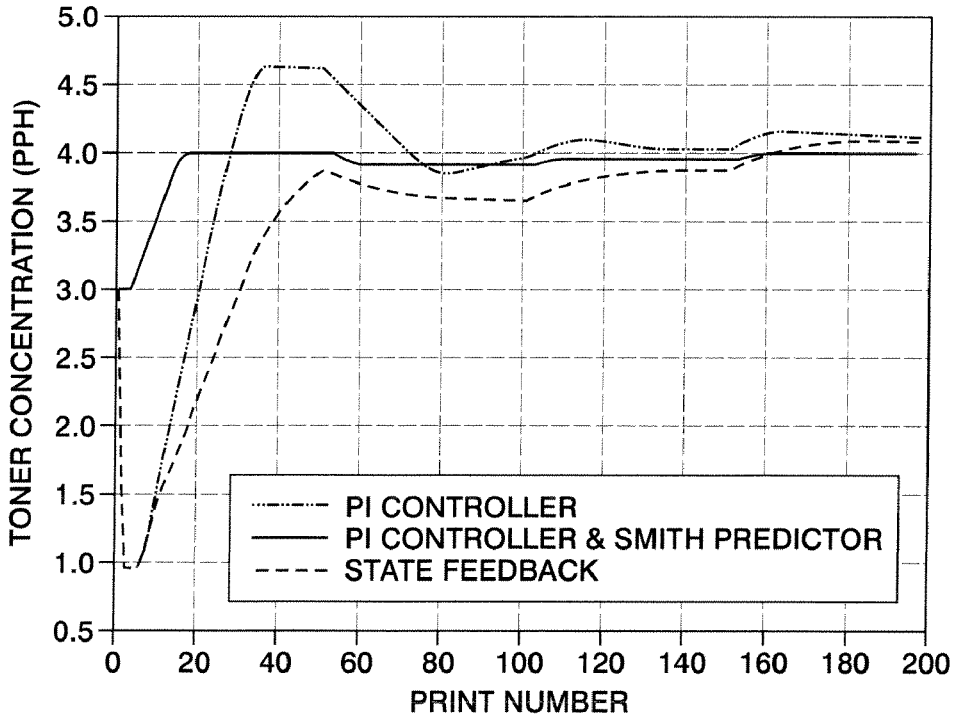
FIG. 3 Illustrates a toner concentration response of three controllers (proportional integral (PI) controller), PI with Smith Predictor, and, State feedback) without any noise.
Figure 4:
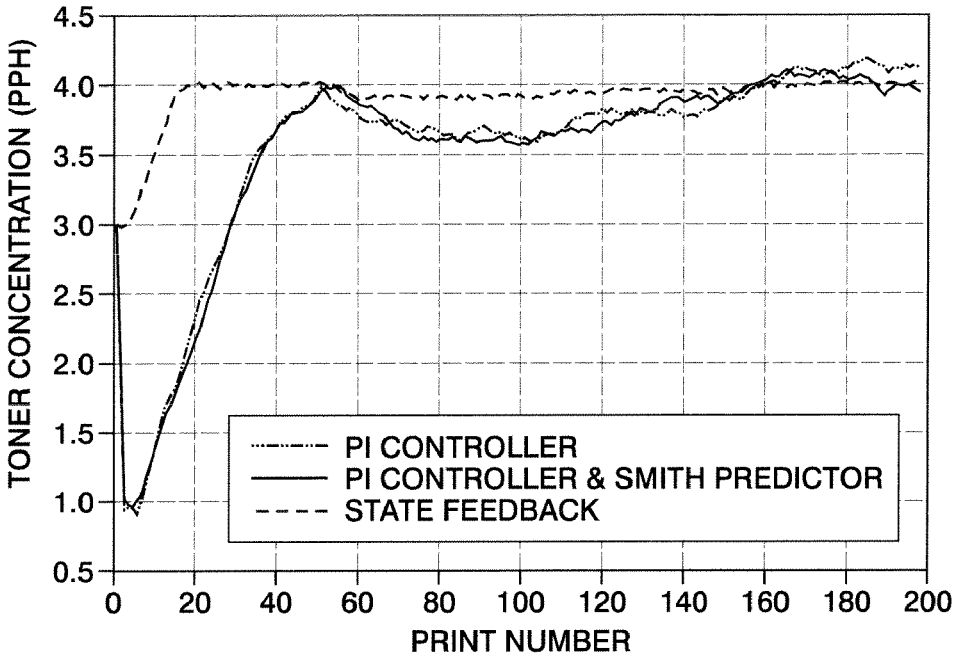
FIG. 4 Illustrates a toner concentration response of three controllers (proportional integral (PI) controller), PI with Smith Predictor, and, State feedback) with 1% sensor noise.

FIG. 2 shows an example of the area coverage change induced into our simulation in the middle of the TC process. The responses for sensor noises (0, 1%, and 5%, respectively) are shown in FIGS. 3 to 5.

The PI controller gives an overshoot as the target TC is approached. This is because of the dynamics of the PI controller. By including the Smith predictor, overshoot has been reduced effectively (see FIG. 5). The x-axis in these plots is the number of prints, while the y-axis is the toner concentration in pph. The response of the state feedback controller remains good even though noise is introduced to the sensor.

Figure 5:
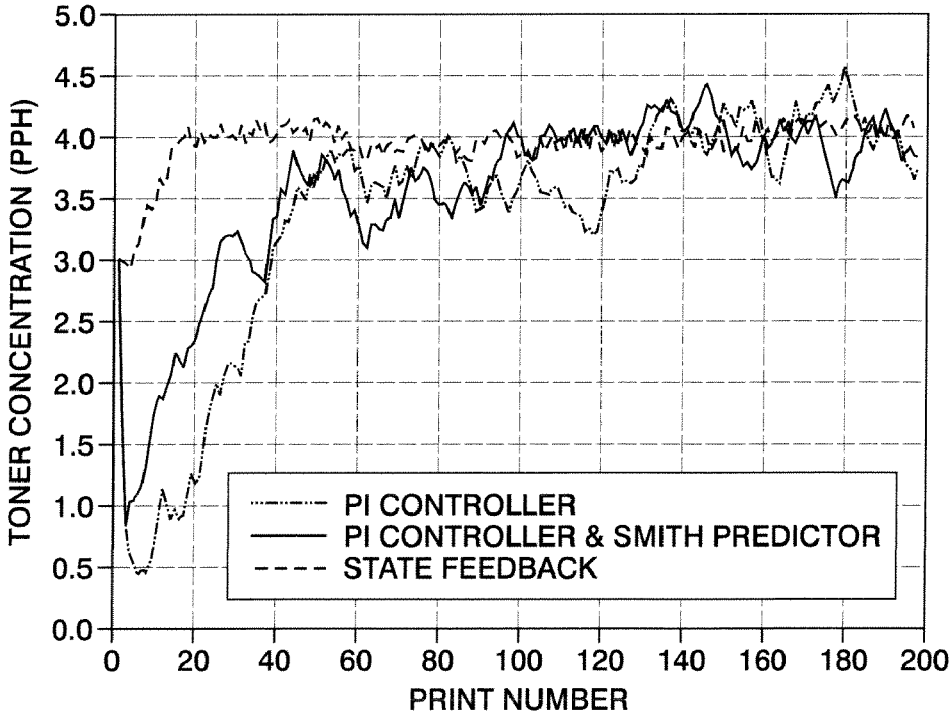
FIG. 5 Illustrates a toner concentration response of three controllers (proportional integral (PI) controller), PI with Smith Predictor, and, State feedback) with 5% sensor noise.

In FIG. 5, the PI controller without Smith predictor show more oscillations. But in the case of state feedback method, the performance is significantly improved, and the error between the desired target and the sensor output is considerably reduced. The state feedback technique with estimator does a much better job because the output is fed back to all the states instead of just one as in the PI controller.

The responses of the three methods can be compared by comparing their figures of merit. The figure of merit is calculated by measuring the area under the response curve (tcfiltered vs. print number). The exemplary figure of merit is a step response from 3 pph to 4 pph (from about 3% to about 4%). The tcfiltered which is above the target TC line is subtracted from the respective area. The table below shows the comparison of figures of merit for all three of the aforementioned methods.

| Percentage of noise (%) | Figure of merit (%) PI Controller | Smith Predictor + PI | State Feedback |
|---|---|---|---|
| 0 | 93.6394 | 95.0658 | 96.6266 |
| 1 | 92.8828 | 94.5772 | 96.4061 |
| 5 | 85.9056 | 88.2217 | 94.4501 |

The figure of merit table shows that introduction of a smith predictor improves the performance of the system, as opposed to using a PI controller alone. The state feedback method can provide improved performance relative to the other two methods because the states are estimated from the sensor and each of those states is controlled as the system evolves over time, which effectively gives improved dynamic performance.

Figure 6:
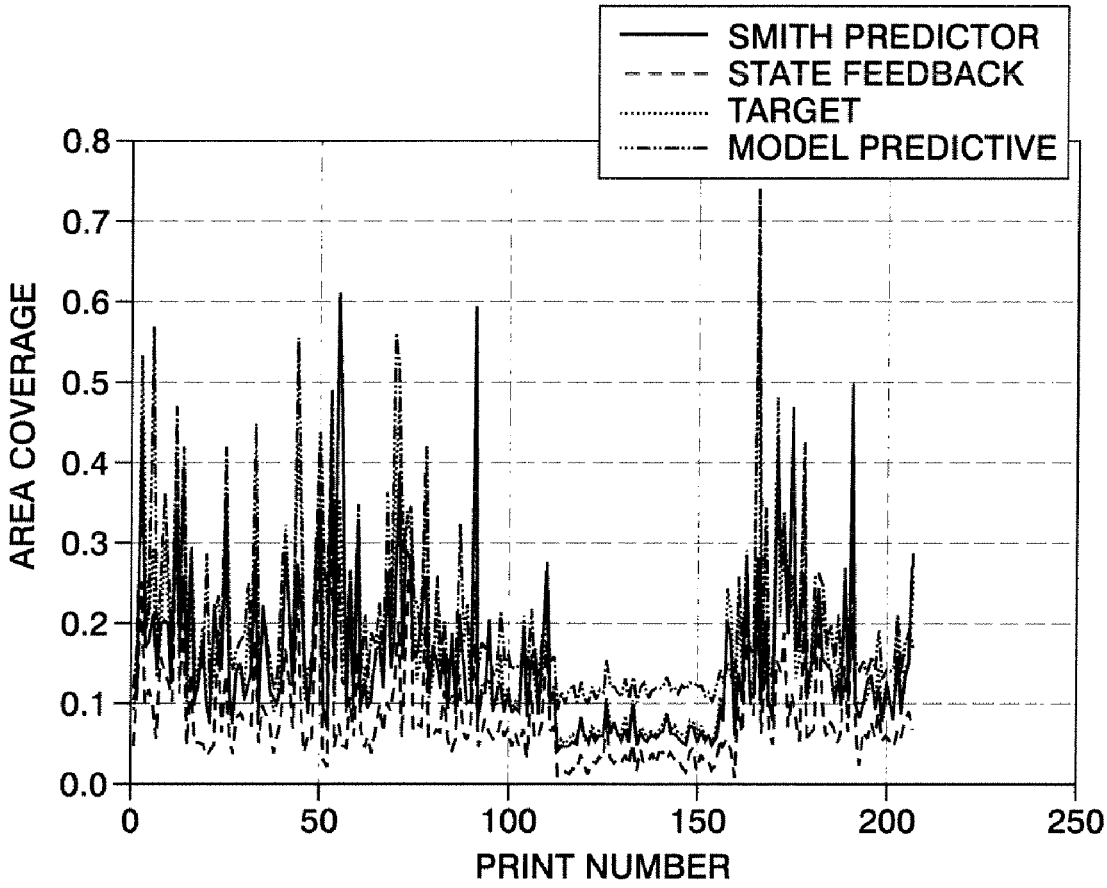
FIG. 6 Illustrates measured area coverage profile of magazine sample used for the TC control simulation; and, FIG. 7 Illustrates the results of the three algorithms with 5% sensor noise and area coverage noise of FIG. 6.
Figure 7:
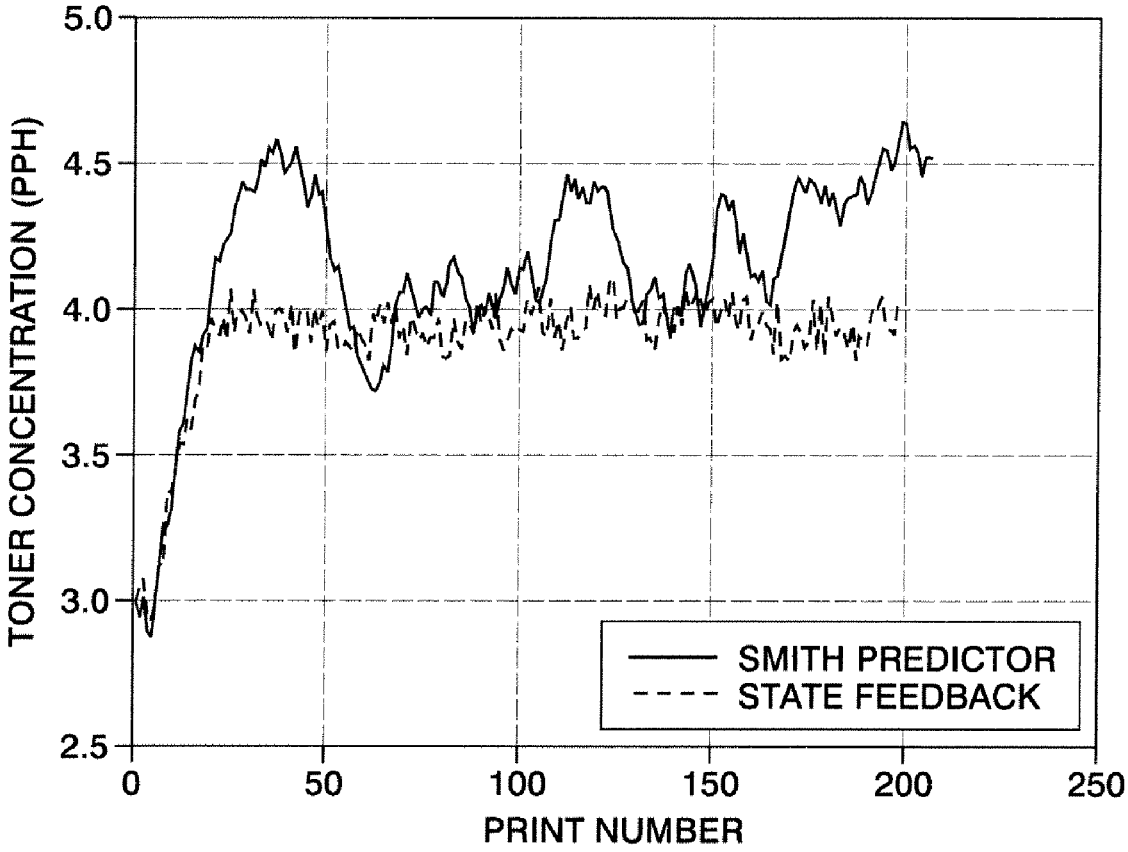

Also, in FIG. 7 we show the TC control loop simulations for expected toner consumption (FIG. 6) when a typical color magazine is printed. Simulations are shown for single separation. The state feedback controller can outperform the PI controller with Smith predictor method.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. In an imaging machine having an imaging member, a method for maintaining a toner concentration is provided comprising:

determining a toner concentration (TC) measurement using a sensor;

computing a state estimator output from the TC and a pre-stored estimator gain matrix, $K_e$;

computing an estimated target state from the state estimator and a pre-stored controller gain matrix, K;

computing a duty cycle from the estimated target state, pixel count data, and pre-stored target decomposer output; and, updating the duty cycle by repeating the above method for the next TC cycle.

2. The method according to claim 1, wherein the TC is defined by the relationship $$tc\text{filtered}(k+1)=C^*(1/\text{Carriermass})^*x(k)-(1/\text{Carriermass})^*x_{\mu+2}(k), \text{ and}$$

$$tc(k)=\text{tonermass}(k)/\text{carriermass}(k), \text{ wherein } k \text{ is a print iteration.}$$

3. The method according to claim 2, wherein the toner mass is defined by the relationship $$\text{tonermass}(k+1)=C^*x(k)-x_{\mu+2}(k).$$

4. The method according to claim 2, wherein the state estimator output is defined by the relationship $$xh(k+1)=A^*xh(k)+B^*\text{massdispensed}(k)+K_e^*\text{Carriermass}^*[tc\text{filtered}(k)-(1/\text{Carriermass})^*xh(k)]; \text{ and,}$$

$$\text{massdispensed}(k)=\text{maxdisprate}^*\text{period}^*\text{dutycyclefilt}(k).$$

5. The method according to claim 4, wherein the estimated target state is defined by the relationship $$x\text{target}h(k)=K^*xh(k).$$

6. The method according to claim 5, wherein the duty cycle is defined by the relationship $$\text{Dutycycle}(k)=x\text{target}-x\text{target}h(k)+\text{areacoverage}(k+\mu).$$

7. In an imaging machine having an imaging member, a method for maintaining a toner concentration is provided comprising:

determining a toner concentration (TC) measurement for a TC iteration cycle (k) using a sensor wherein the TC is defined by the relationship $$tc\text{filtered}(k+1)=C^*(1/\text{Carriermass})^*x(k)-(1/\text{Carriermass})^*x_{\mu+2}(k), \text{ and}$$

$$tc(k)=\text{tonermass}(k)/\text{carriermass}(k);$$

computing a state estimator output from the TC and a pre-stored estimator gain matrix, $K_e$ wherein the state estimator output is defined by the relationship $$xh(k+1)=A^*xh(k)+B^*\text{massdispensed}(k)+K_e^*\text{Carriermass}^*[tc\text{filtered}(k)-(1/\text{Carriermass})^*xh(k)], \text{ and}$$

$$\text{massdispensed}(k)=\text{maxdisprate}^*\text{period}^*\text{dutycyclefilt}(k);$$

computing an estimated target state from the state estimator and a pre-stored controller gain matrix, K wherein the estimated target state is defined by the relationship $$xtargeth(k)=K*xh(k); \text{ and,}$$

computing a duty cycle from the estimated target state, pixel count data, and pre-stored target decomposer output, wherein the duty cycle is defined by the relationship $$\text{Dutycycle}(k)=xtarget-xtargeth(k)+\text{areacoverage}(k+\mu).$$

8. The method according to claim 7, wherein the toner mass is defined by the relationship $$\text{tonermass}(k+1)=C*x(k)-x_{\mu+2}(k).$$

9. The method according to claim 8, further comprising repeating claims 7 and 8 for updating the duty cycle for the next TC cycle.

10. The method according to claim 9, wherein the pre-stored estimator gain matrix, $K_e$ is defined by the relationship $$K_e=\text{place}(A',C*(1/\text{Carriermass}),p) \text{ where } p=[p1;p2]].$$

11. The method according to claim 1, further comprising:

determining the toner concentration wherein the toner concentration includes a previous (k) toner mass divided by a carrier mass of toner;

determining the toner mass at discrete delay cycles wherein the delay cycles are split into states and the states are defined as toner mass quantities at discrete delay cycles; and, wherein the states are defined by the matrix:

$$\begin{bmatrix} x_1(k+1) \\ x_2(k+1) \\ \vdots \\ \vdots \\ x_{\mu+1}(k+1) \end{bmatrix} = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \begin{bmatrix} x_1(k) \\ x_2(k) \\ \vdots \\ \vdots \\ x_{\mu+1}(k) \end{bmatrix} + \begin{bmatrix} 1 \\ 0 \\ \vdots \\ \vdots \\ 0 \end{bmatrix} * massdispensed(k)$$

$$tonermass(k) = [\,0 \quad 0 \quad \dots \quad \dots \quad 1\,] * \begin{bmatrix} x_1(k) \\ x_2(k) \\ \vdots \\ \vdots \\ x_{\mu+1}(k) \end{bmatrix} - x_{\mu+2}(k)$$

-continued $$A = \begin{bmatrix} 1 & 0 & 0 & \dots & 0 \\ 1 & 0 & & \dots & 0 \\ 0 & 1 & \dots & \dots & 0 \\ \vdots & \vdots & \vdots & \vdots & \vdots \\ 0 & \dots & \dots & 1 & 0 \end{bmatrix} \text{ and } B = \begin{bmatrix} 1 \\ 0 \\ \vdots \\ \vdots \\ 0 \end{bmatrix} \quad C = [\,0 \quad 0 \quad \dots \quad \dots \quad 1\,].$$

12. The method according to claim 11, wherein the TC is defined by the relationship:

$$tc\text{filtered}(k+1)=C*(1/\text{Carriermass})*x(k)-(1/\text{Carriermass})*x_{\mu+2}(k).$$

13. The method according to claim 12, wherein the toner mass is defined by the relationship:

$$\text{tonermass}(k+1)=C*x(k)-x_{\mu+2}(k).$$

14. The method according to claim 13, further comprising:

computing a state estimator output from the TC and a pre-stored estimator gain matrix, $K_e$ wherein the state estimator output is defined by the relationship:

$$xh(k+1)=A*xh(k)+B*\text{massdispensed}(k)+K_e*\text{Carriermass}*[tc\text{filtered}(k)-(1/\text{Carriermass})*xh(k)], \text{ and}$$

$$\text{massdispensed}(k)=\text{maxdisprate}*\text{period}*\text{dutycyclefilt}(k).$$

15. The method according to claim 14, further comprising:

computing an estimated target state from the state estimator and a pre-stored controller gain matrix, K wherein the estimated target state is defined by the relationship $$xtargeth(k)=K*xh(k).$$

16. The method according to claim 15, further comprising:

computing a duty cycle from the estimated target state, pixel count data, and pre-stored target decomposer output, wherein the duty cycle is defined by the relationship $$\text{Dutycycle}(k)=xtarget-xtargeth(k)+\text{areacoverage}(k+\mu).$$

17. The method according to claim 16, further comprising:

updating the duty cycle by repeating the defined relationships included in claims 12 through 16 for a next duty cycle.

* * * * *